United States Patent [19]

Marchetti

[11] Patent Number: 4,972,654

[45] Date of Patent: Nov. 27, 1990

[54] DEVICE FOR THE CLOSING OF THE UPPER LATERAL FLAPS OF PARALLELEPIPEDAL CASES HAVING FLAPS WHICH CAN BE TURNED OVER, PARTICULARLY FOR VERY LONG CASES

[76] Inventor: Augusto Marchetti, Piazza Sicilia, 7, 20146 Milan, Italy

[21] Appl. No.: 354,718

[22] Filed: May 22, 1989

[30] Foreign Application Priority Data

Jun. 7, 1988 [IT] Italy ..... 20872 A/88

[51] Int. Cl.[5] ..... B65B 7/20; B65B 57/02

[52] U.S. Cl. ..... 53/76; 53/374; 53/382; 493/179; 493/183

[58] Field of Search ..... 53/374, 375, 381 R, 53/491, 67, 76, 382; 493/178, 179, 183

[56] References Cited

U.S. PATENT DOCUMENTS

| | | | |
|---|---|---|---|
| 2,969,630 | 1/1961 | Shenigo | 53/374 |
| 3,603,061 | 9/1971 | Harmes | 53/374 |
| 4,262,469 | 4/1981 | Ooms et al. | 53/374 X |
| 4,295,841 | 10/1981 | Ward, Jr. | 493/179 X |
| 4,331,435 | 5/1982 | Nowacki | 493/178 |
| 4,422,282 | 12/1983 | Marchetti | 493/183 X |
| 4,524,560 | 6/1985 | Goodman | 53/374 |
| 4,525,980 | 7/1985 | Ulrich et al. | 53/374 |
| 4,642,966 | 2/1987 | Marchetti | 53/374 |
| 4,698,950 | 10/1987 | Marchetti | 53/374 |

*Primary Examiner*—Robert L. Spruill
*Assistant Examiner*—Linda B. Johnson
*Attorney, Agent, or Firm*—Cushman, Darby & Cushman

[57] ABSTRACT

A device for closing the upper lateral flaps of long parallelepiped cases includes a pair of helical guides with a reduced longitudinal length and a pair of extension arms controllable so that they may be displaced from an at rest position to an operating position. In the latter position the two arms are arranged as an extension of the helical guides towards the inlet to the device so as to force the lateral flaps of the case to accomplish the closing engagement with the helices.

5 Claims, 11 Drawing Sheets

DEVICE FOR THE CLOSING OF THE UPPER LATERAL FLAPS OF PARALLELEPIPEDAL CASES HAVING FLAPS WHICH CAN BE TURNED OVER, PARTICULARLY FOR VERY LONG CASES

BACKGROUND OF THE INVENTION

The present invention relates to a device for the closing of the upper lateral flaps of parallelepiped cases having flaps which can be turned over, particularly for very long cases.

Automatic machines are known which are capable of executing in rapid succession the closing of the upper flaps (first the front one, then the rear one and finally the lateral ones) of a cardboard case which advances with the upper flaps erect, so as to prepare the case in a condition suitable for the subsequent application of an adhesive sealing tape along the separation gap between respective free edges of the lateral flaps folded in the closed position.

For the closing of the lateral flaps the above described machines usually employ a device formed by a pair of helical guides, which, upon meeting the erect lateral flaps, cause their progressive rotation towards the closed position.

In particular, machines are known which, according to the Italian patent application No. 19788 A/85 dated Mar. 6, 1985 in the name of the same inventor (and which corresponds to U.S. Pat. No. 4,698,950, issued Oct. 13, 1987), employ helical guides each formed by two integral and longitudinally staggered portions of a helix, which, one more external and the other more internal, are built upon oblique inlet extremities having horizontal outlet extremities, so that they are engageable by the erect lateral flaps of cases of greater and lesser width , repectively, to execute, in both instances the correct turning over of the flaps in the closed position.

In such a way the device can execute the closing of the lateral flaps of cases having variable width without it being required that the distance between the helices be adjusted each time. The more external portion provided helix to the initial engagement with the lateral flaps of the wider cases, and the more internal portion provide helix to the initial engagement with the lateral flaps of the narrower cases.

Even with this arrangement their remains, however, with no solution the problem of very long cases, whose lateral flaps may enter into engagement with the closing helices, and thus start their closing movement, before the closing device of the rear flap, located upstream from the helices at a fixed distance from them, has been able to act so as to cause the closing of the rear flap. In such an instance as will be understood, the case will not be closed properly.

SUMMARY OF THE INVENTION

In view of the state of the art, referred to above the object of the present invention is to provide a device to permit one to execute effectively the closing of the lateral flaps of even very long cases. According to the invention, this object is attained with a device characterized in that it comprises a pair of helical guides having a reduced longitudinal size (compared with those provided in the prior art devices referred to above) and a pair of extension arms controllable so that they may be displaced from an at rest position outside the path of advancement of the erect lateral flaps of the case, to an operating position wherein the arms are arranged so as to form an extension of the helical guides towards the inlet to the machine so as to force the lateral flaps of the case to accomplish the closing engagement with the guides.

In this way, the lateral flaps even of very long cases do not get to engage the closing guides (of the traditional type or, more preferably, of the type described above with two longitudinally staggered helical portions) and thus to start the closing movement only after the command to move to the operating position has been imparted to the extension arms, which can be achieved easisly only after the closing device of the upper flap has completed its action. If the case is short, the command for the two arms is given earlier, if the case is long, it is given later. In any event, the two lateral flaps start to close only after the rear flap has been closed. This means having a case with properly closed flaps whatever the length of the case.

BRIEF DESCRIPTION OF THE DRAWINGS

The features of the present invention will be made more evident by the following detailed description of one embodiment illustrated, as an example, in the enclosed drawings, wherein.

DETAILED DESCRIPTION

Figure 1:
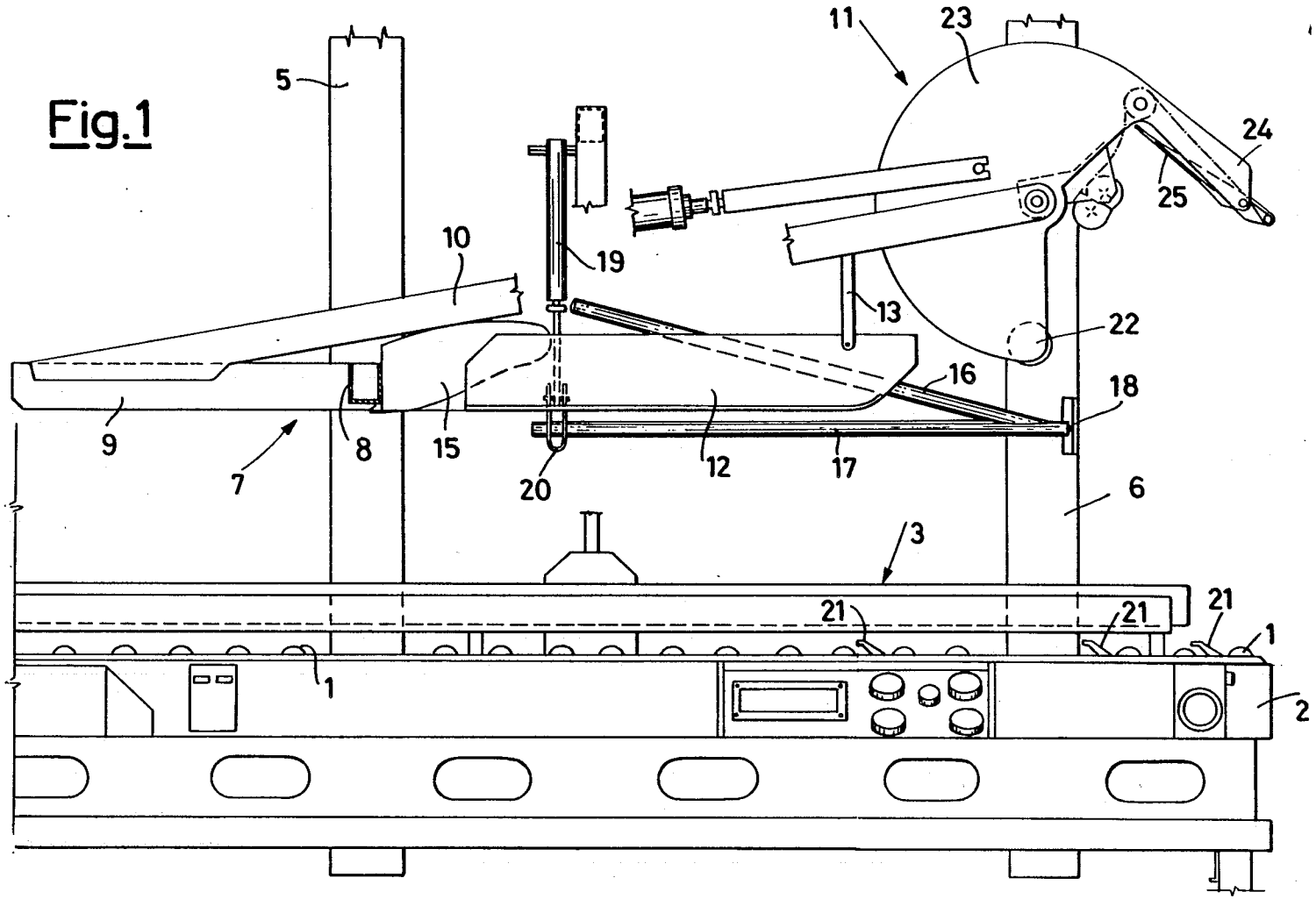
FIG. 1 is a schematic longitudinal cross-section of a machine for closing cardboard cases, which includes a closing device for the lateral flaps, according to the present invention.

The machine shown in the drawings comprises first of all, a support and advancement table for the cases, which is defined by a succession of idling rollers 1 supported by a base frame 2. On the two sides of the support table there are arranged two belt-operated driving assemblies 3, which by means not shown and in themselves known may be automatically positioned or adjusted at a reciprocal distance such as to allow the engagement with the sides of the cases for the latters'advancement (from right to left, looking at FIG, 1).

Lateral columns 5 and 6 sustain in a vertically slidable way an upper structure 7 including a cross-beam 8. From the latter there extends in the direction of the advancement of the cases a pair of horizontal arms 9, from which there extends at an angle in the opposite direction, a similar structure sustaining two arms 10 for a device for the closing of the upper extreme flaps of the cases this similar structure is indicated as a whole by the numerical reference 11 and consists essentially of a rotating disk 23 having a part 22 for the closing of the front flap and a part 24 for the closing of the rear flap.

The device 11 has been the object of the utility model application No. 21011 B/85 dated Mar. 6, 1985 by the same inventor (and corresponds to U.S. Pat. No. 4,642,966, issued Feb. 17, 1987), to which reference is made for a detailed description of the structure and of the operation of the device itself. For the sake of the present description it will be sufficient to say that it effects the sequential closing of the front flap and rear flap of each case, before the closing of the lateral flaps which, on the other hand, is executed by the device according to the present invention.

In combination with the closing device 11, there operates a device for maintaining the extreme flaps in the closed position, which is constituted by an inverted-T structure 12 (which is known in itself) supported in the horizontal position by the oblique structure 10 by means of a pair of hinged parallel rods 13. The distance of the lower horizontal wing of the structure 12 from the support table defined by the rollers 1 clearly defines the height of the cases acceptable by the machine. Such distance, and thus the acceptable height, may be varied automatically or may be adjusted manually according to the type of machine.

Figure 2:
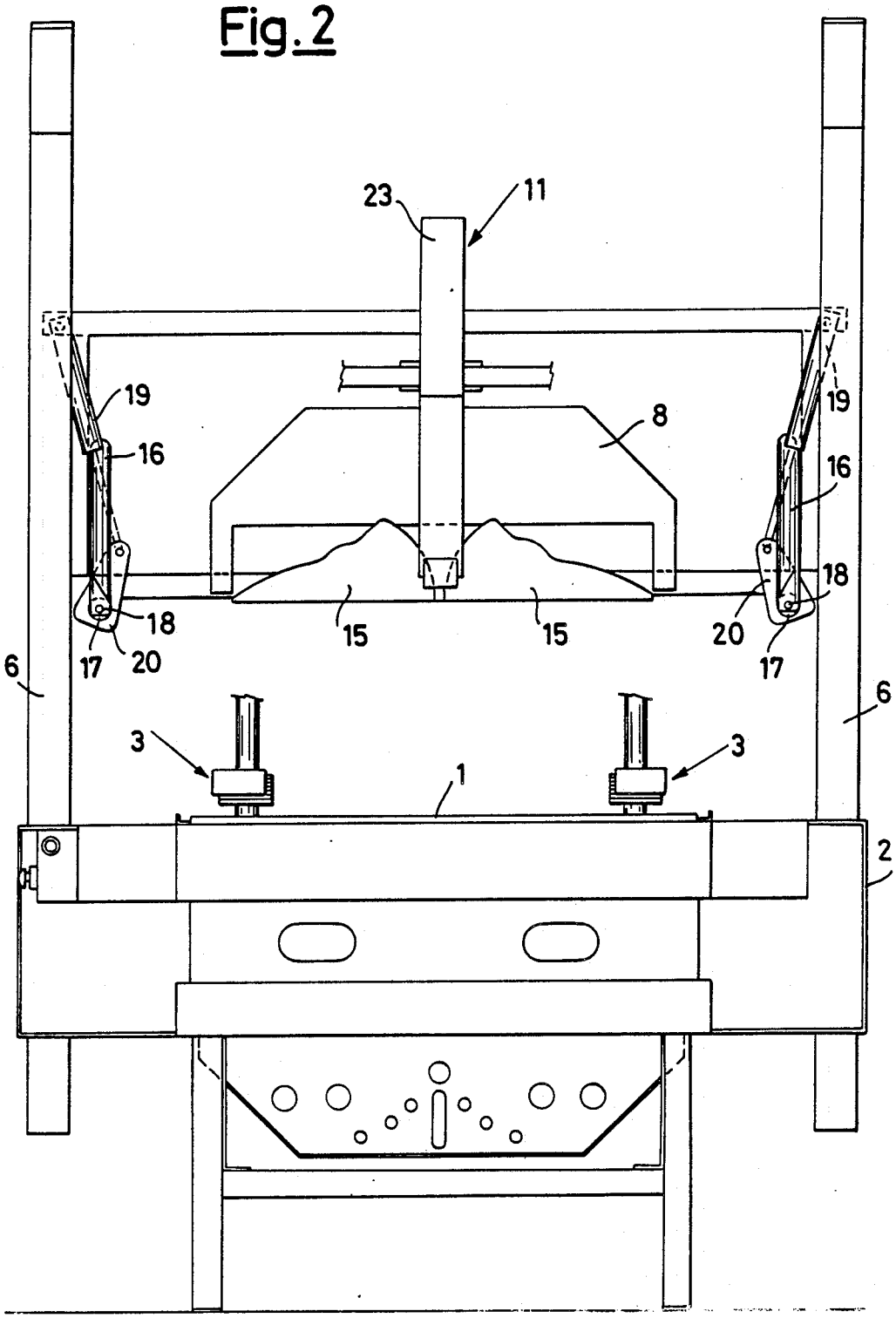
FIG. 2 shows the machine in a front view from the case inlet extremity.
Figure 3:
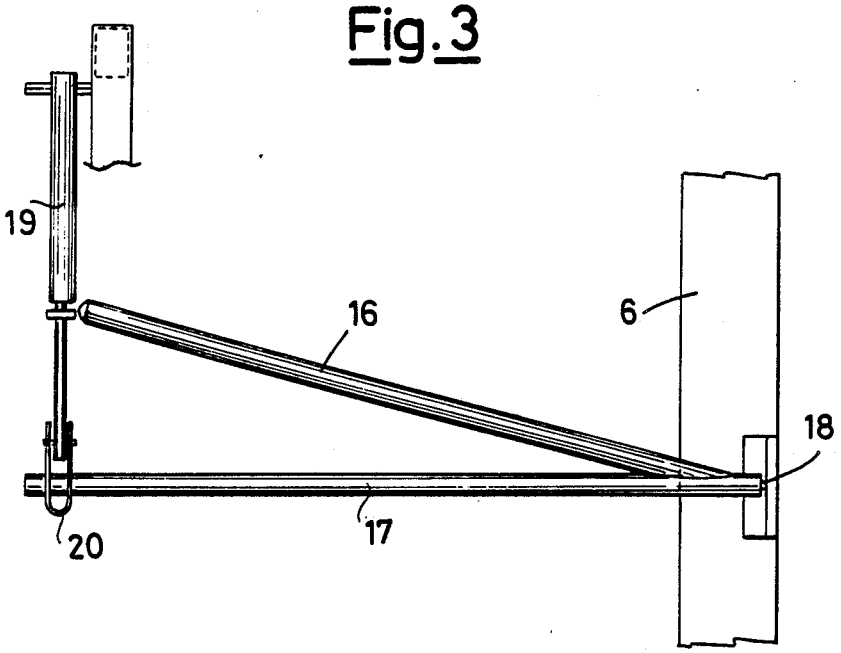
FIG. 3 shows the detail enlarged, in a lateral view in the at rest position, for the closing device of the lateral flaps.
Figure 4:
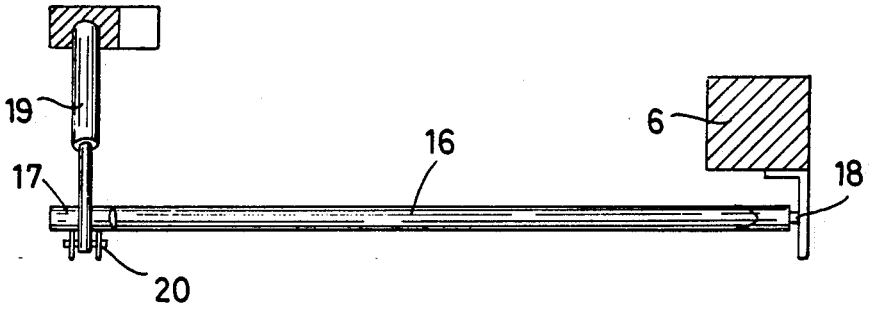
FIG. 4 shows the above device in a plan view from above, again in the at rest position.

For the closing of the lateral flaps of the cases, there is provided, as already said, the device according to the invention, which comprises a pair of symmetrical covergent guides 15 having limited length, fastened to the cross-beam 8 (FIGS. 1 and 2). Each of the guides 15 is preferably formed of two helical portions positioned side by side and integral, the first more external and the other more internal, longitudinally staggered one with respect to the other, according to the mentioned Italian patent application No. 19788 A/85 of the same inventor (and aforementioned U.S. Pat. No. 4,698,950).

The device according to the invention also comprises, between the device 11 and the helices 15, a pair of rectilinear arms 16, which extends at an angle, like a cantilever, from respective horizontal pivots 17 located along opposite sides of the machine. As shown in FIGS. 1–4, each pivot 17 is rotatably supported in 18 by a respective column 6 and may be made to rotate by a respective pneumatic cylinder 19 by means of a fork-shaped bracket 20. Due to such rotation, the respective arm 16 is displaceable from the at rest position of FIGS. 1–8, in which the arm itself is located outside the path of advancement of the cases, to the operating position of FIGS. 9–11, in which the arm 16 is positioned as an extension of a respective helix 15.

Along the path of advancement of the cases there are lastly interposed between the rollers some position probes, of which, for this description the interesting one is the one indicated by the numerical reference 21. It should, in any case, be pointed out that the practice of the present invention does not depend either on the type, or on the number or on the position of such probes, which are known in themselves and which form a part of an electronic control circuit which is within the reach of any artisan and is thus not described here in detail.

The mode of operation of the machine illustrated in the drawings is the following: A case 31 to be closed and sealed is placed on the roller table 1 with its upper flaps (front 32, rear 33, lateral 34) in their erect positions. The case is made to advance by the driving units 3 (suitably adjusted or brought together automatically), once the height of the structure 8 and thus that of the device 11, of the guides 12 and 15 of the pivots 17 has been adjusted or set automatically.

Figure 5:
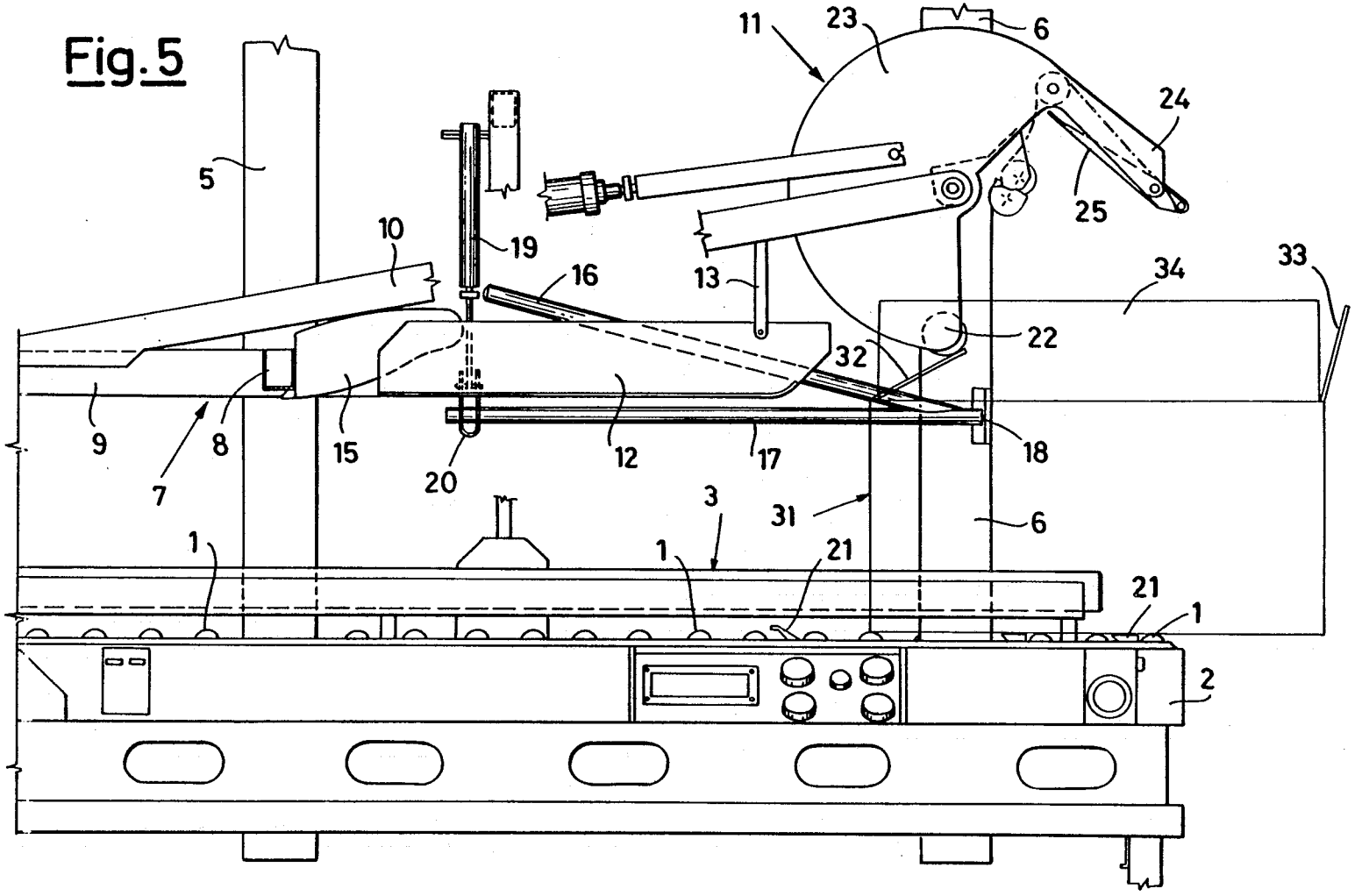
FIGS. 5–9 show subsequent operating stages of the machine, represented in a schematic longitudinal cross-section as in FIG. 1.
Figure 6:
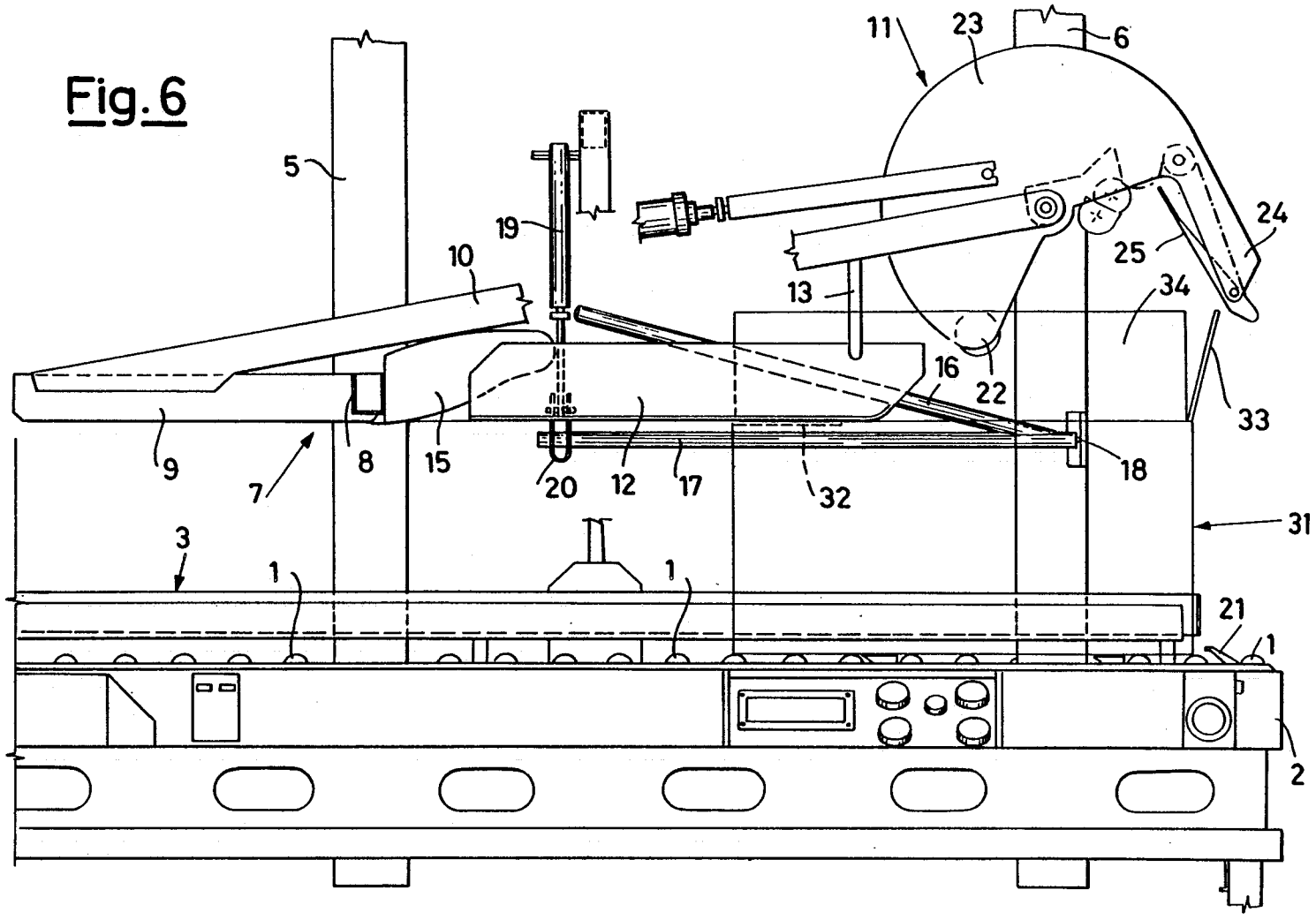

In the first instance, the front flap 32 meets a part 22 of the device 11, which, by force of contrast, executes the closing of the above-mentioned flap (FIG. 5). Immediately afterwards, the same flap 32 is taken under the horizontal guide 12, which maintains it in the closed position while the disk 23 starts to rotate in a clockwise direction (FIG. 6).

Figure 7:
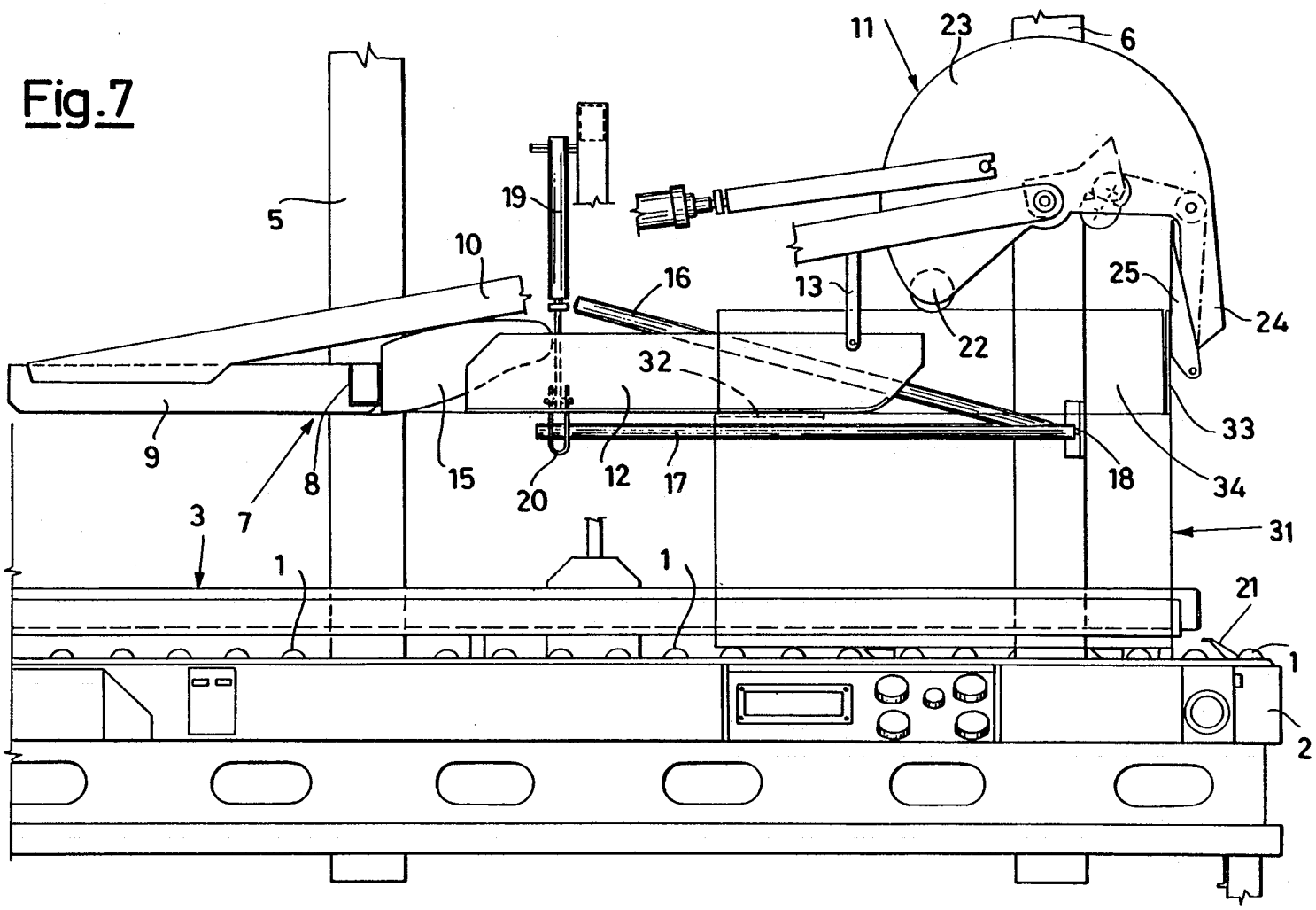
Figure 8:
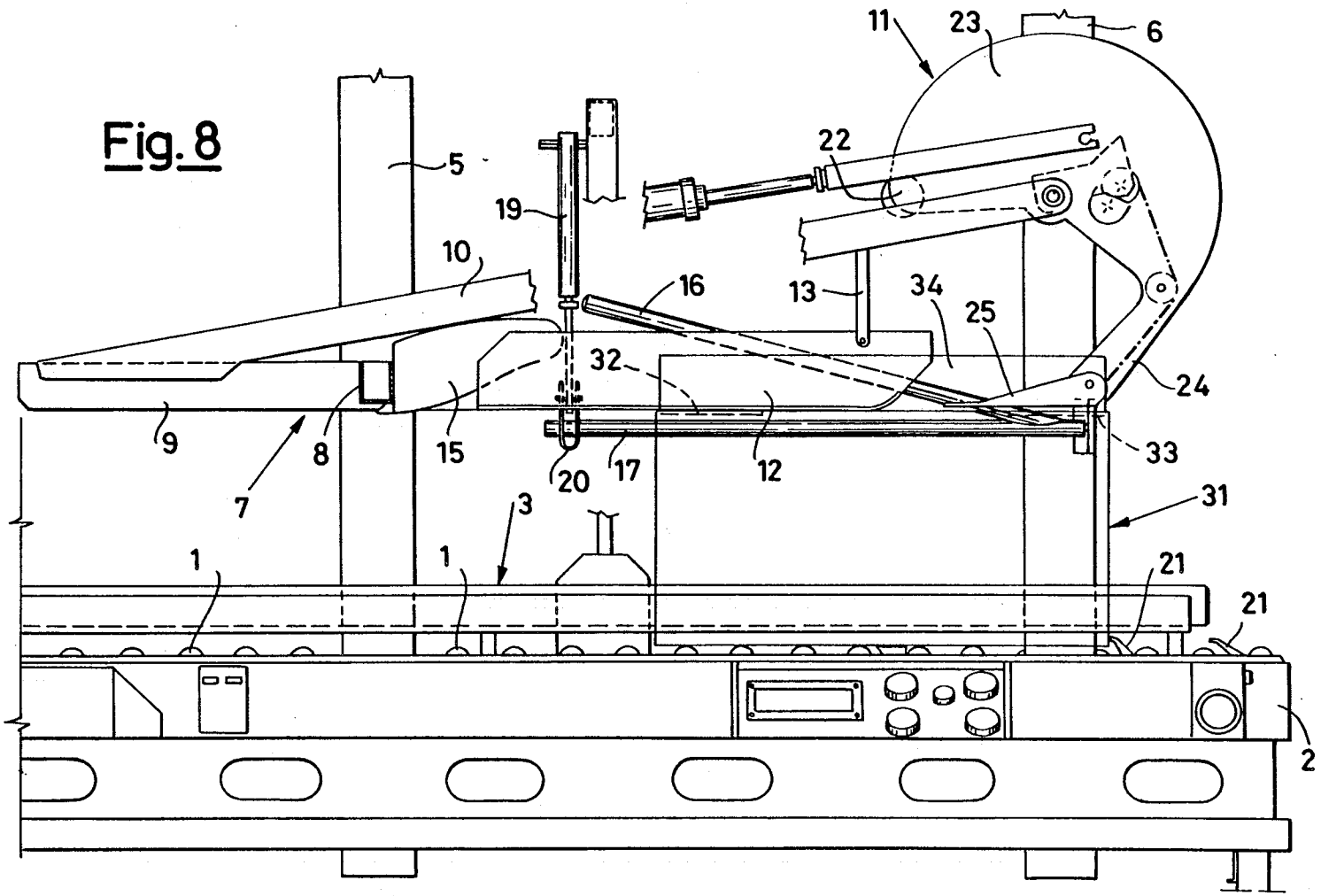

While the advancement of the case continues, the rotation of the disk 23 also continues, which with its part 24, including a counterrotating vane 25, executes the closing of the rear flap 33 (FIGS. 7 and 8).

Figure 9:
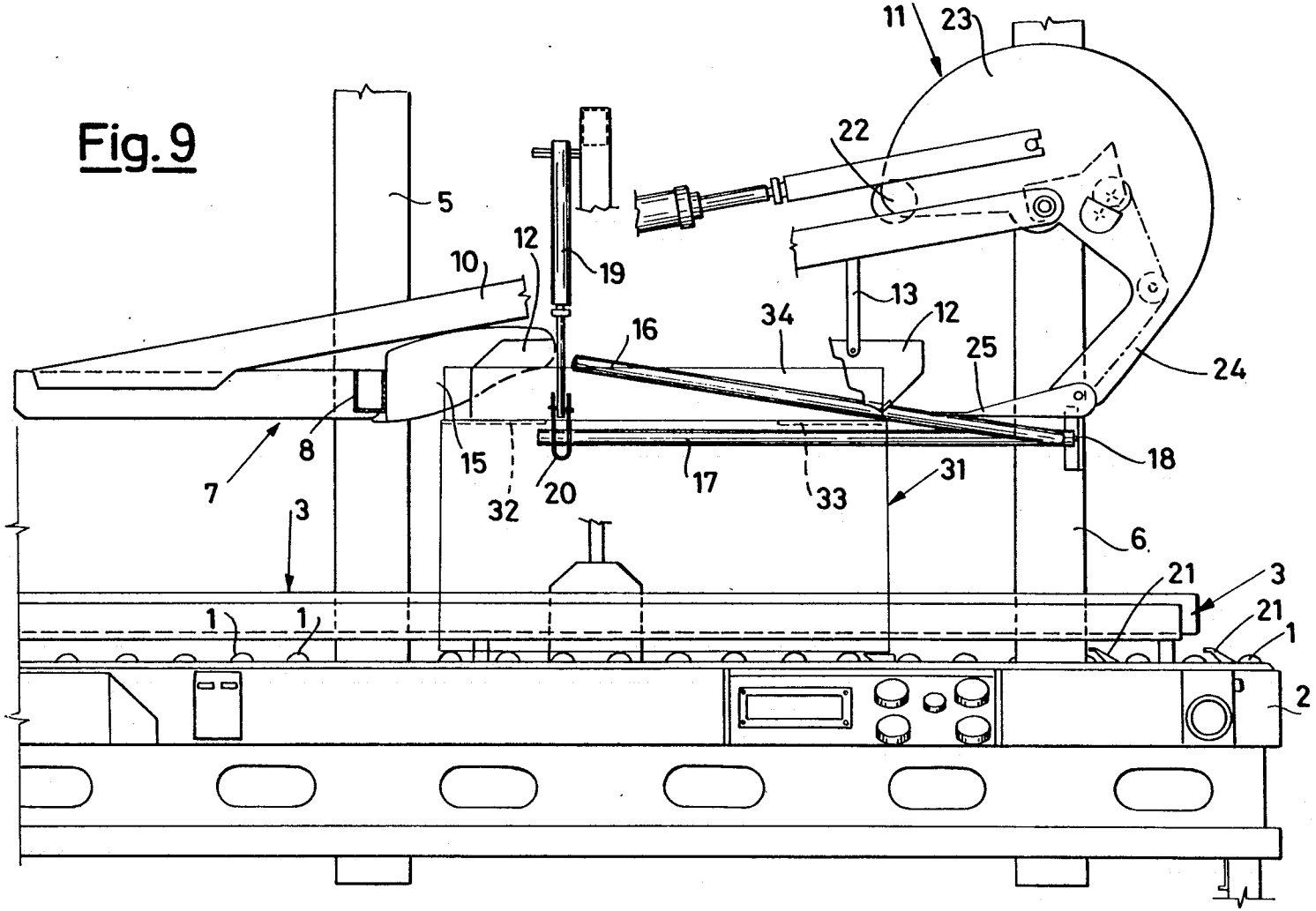
Figure 10:
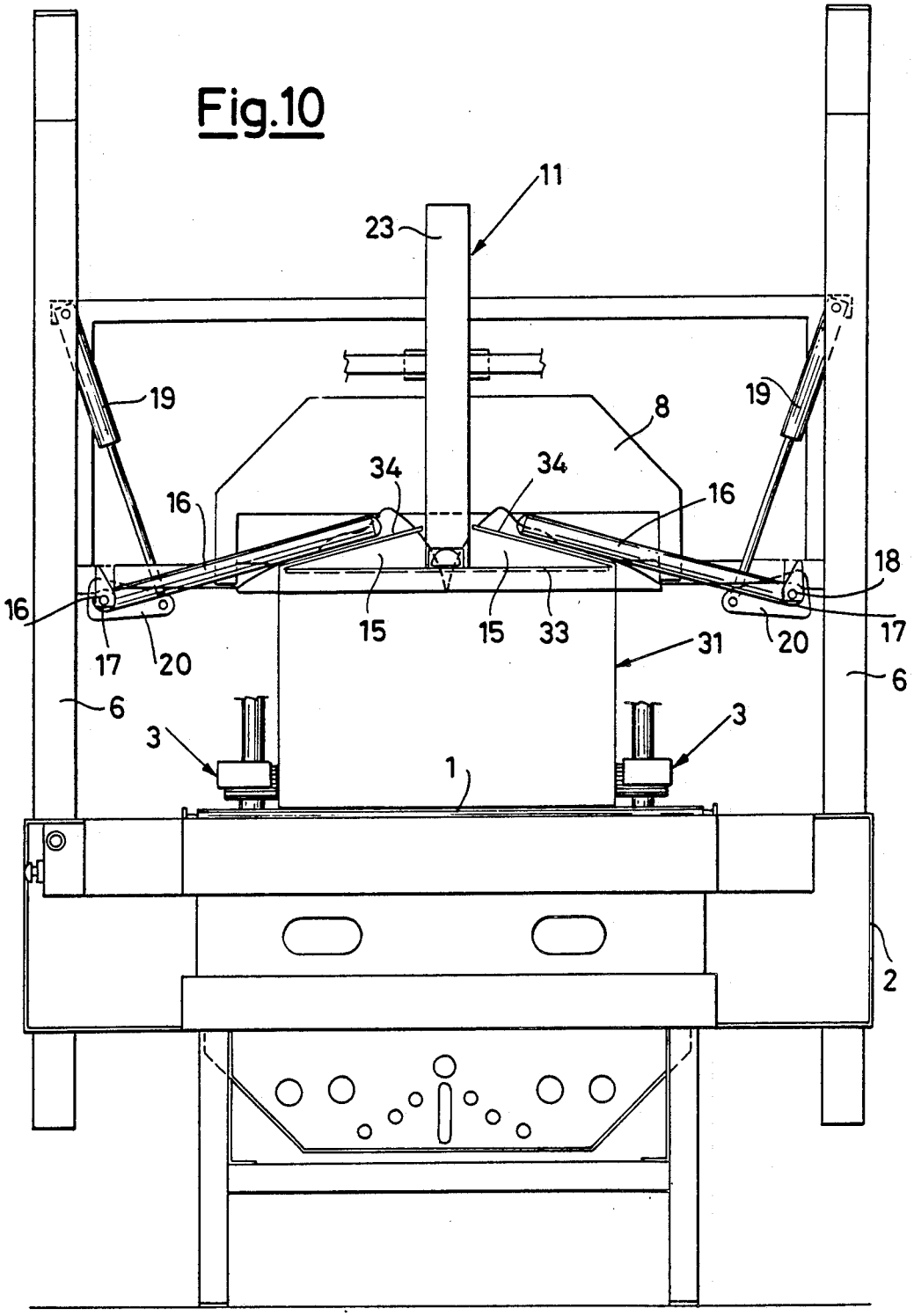
FIG. 10 shows the machine in a front view as in FIG. 2, in the operating stage of FIG. 9.
Figure 11:
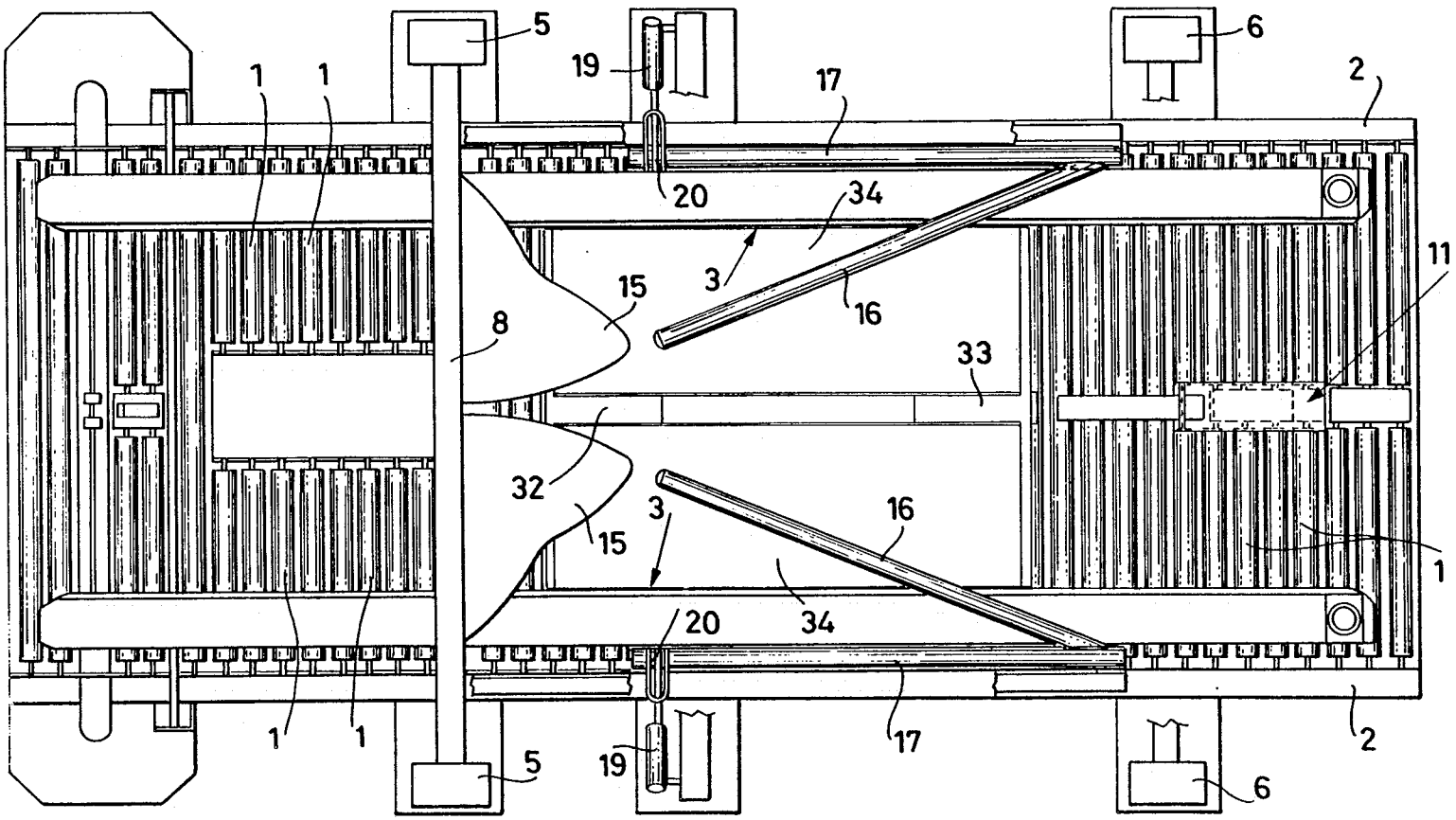
FIG. 11 shows the machine in a plan view from above, again in the operating stage of FIGS. 9 and 10.

With the rear flap already closed, the bottom of the case abandons the probe 21 (FIG. 8), which drives operation of the pneumatic cylinders 19 for the rotation of the pivots 17 and the consequent displacement of the arms 16 towards the operating position, shown in FIGS. 9, 10 and 11. Consequently, the side flaps 33, engaging with the arms 16, start to close, reaching already in the oblique position the helical guides (15), which complete their overturning to the closed position.

As is evident from FIGS. 8 and 9, the reduced length of the helical guides 15 and the combined action of the arms 16 allow for the perfect closing of the lateral flaps of very long cases without their closing movement interfering with the closing movement of the rear flap.

Figure 12:
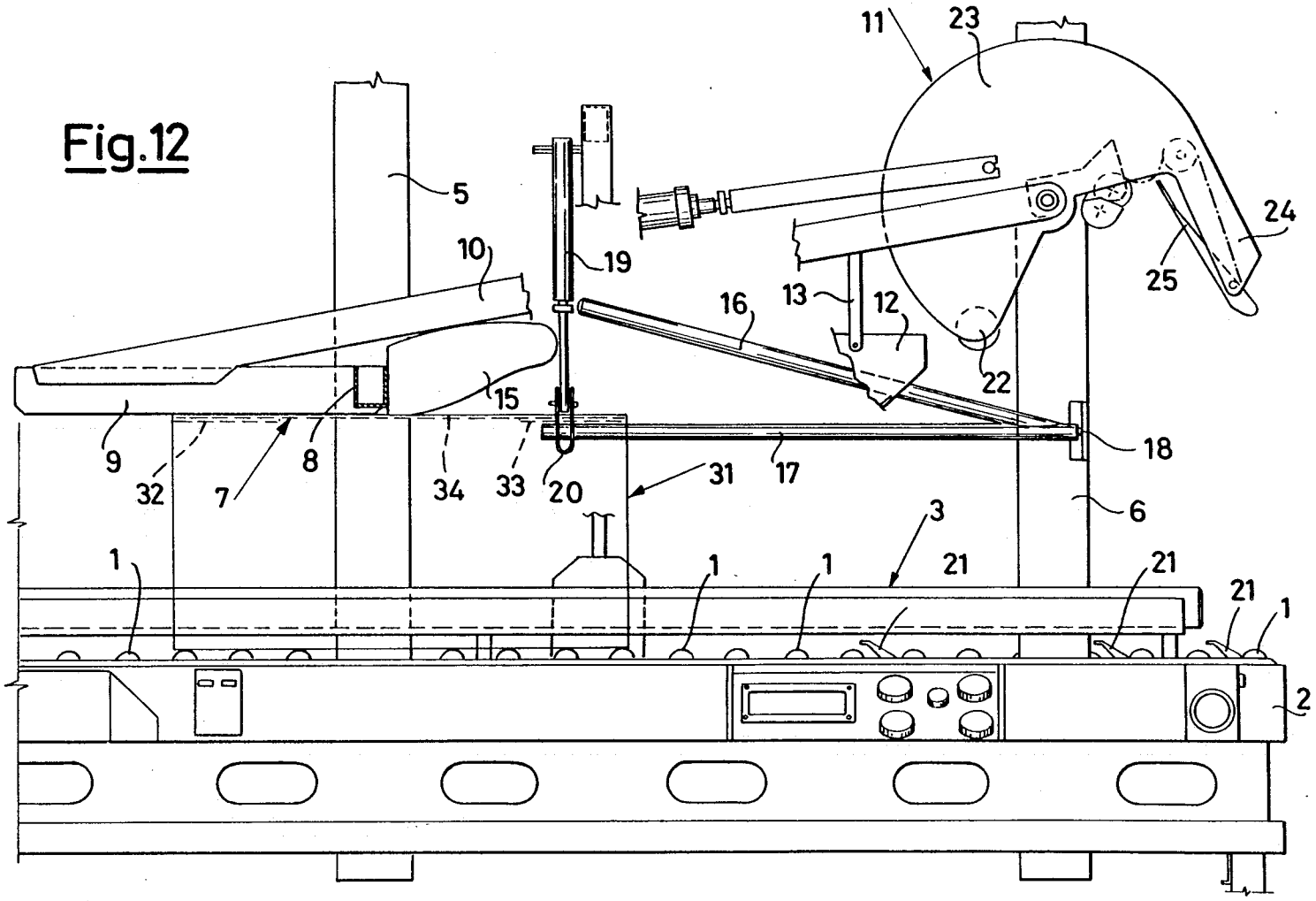
FIG. 12 once again shows the machine as in FIGs. 1 and 5–9, in a further operating stage.

The case which is by now closed continues in its advancement, while the arms 16 return to the at rest position (FIG. 12).

What is claimed is:

1. A device for closing the two opposite lateral flaps of a parallelepiped case from respective upwardly directed, erect positions, to respective medially directed generally horizontal folded-over positions, as the case is advanced in a direction along a path, said device comprising:

a pair of helical guides arranged to engage respective ones of said lateral flaps and thereby folded-over said lateral flaps from said erect positions thereof to said folded-over positions thereof as said case advances in said direction along said path with said lateral flaps engaged with respective ones of said helical guides; and a pair of extension arms and means mounting said arms for controlled displacement between an at rest position in which said extension arms are located outside said path, to an operating position in which said arms are arranged so as to form respective upstream extensions of said helical guides for forcing the lateral flaps of the case into closing engagement with respective ones of said guides, said extension arms when in said operating position diverging obliquely away from one another as they extend upstream away from said helical guides.

2. The device of claim 1, further including:

said extension arms being mounted at respective upstream ends thereof on respective generally longitudinally extending horizontal axis pivot means for movement between said rest position and said operating position; and extensible-contractible piston and cylinder units operatively connected with said pivot means for moving said extension arms between said rest position and said operating position by extension and contraction of said piston and cylinder units.

3. The device of claim 2, further including:

case position sensing means operatively connected with said piston and cylinder units for moving said extension arms between said rest position and said operating position in response to sensations of presence of said case at a predetermined location along said path.

4. The device of claim 1, further comprising:

case position sensing means operatively connected with said extension arms for moving said extension arms between said rest position and said operating position in response to sensations of presence of said case at a predetermined location along said path.

5. The device of claim 3, for also closing a rear flap of the parallelepiped case from an upwardly directed, erect position to a forwardly directed, generally horizontally folded-over position, as the case is advanced in said direction along said path, said device further including:

means arranged to engage said rear flap before said lateral flaps are folded over to said folded-over positions thereof and thereby folded-over said rear flap from said erect position thereof to said folded-over position thereof.

* * * * *